United States Patent [19]

Sheffield

[11] Patent Number: 4,951,872

[45] Date of Patent: Aug. 28, 1990

[54] TRACK JOINTERS

[75] Inventor: Lance R. Sheffield, Sevenoaks, England

[73] Assignee: Sandpipe Computer & Model Services Limited, Kemsing, England

[21] Appl. No.: 294,388

[22] Filed: Jan. 6, 1989

[30] Foreign Application Priority Data

Jan. 9, 1988 [GB] United Kingdom ..... 8800473
Jan. 29, 1988 [GB] United Kingdom ..... 8802062

[51] Int. Cl.[5] ..... E01B 23/00
[52] U.S. Cl. ..... 238/10 E; 238/151
[58] Field of Search ..... 238/151, 10 E, 14.4, 238/219, 220, 225, 226, 235, 243

[56] References Cited

U.S. PATENT DOCUMENTS

| | | | |
|---|---|---|---|
| 838,101 | 12/1906 | Gilges | 238/225 |
| 893,315 | 7/1908 | Ely | 238/225 |
| 1,224,857 | 5/1917 | Laskewitz | 238/235 |
| 1,565,197 | 12/1925 | Porte | 238/235 |
| 1,651,723 | 12/1927 | McCarty | 238/225 |
| 1,798,004 | 3/1931 | Speranza | 238/225 |
| 2,759,676 | 8/1956 | MacDonald | 238/225 |
| 3,602,430 | 8/1971 | Fischer | 238/10 E |
| 3,680,777 | 8/1972 | Arai | 238/10 E |
| 4,223,834 | 9/1980 | Fechter | 238/10 E |
| 4,225,081 | 9/1980 | Ikegame | 238/10 E |

FOREIGN PATENT DOCUMENTS

| | | | |
|---|---|---|---|
| 0516427 | 9/1955 | Canada | 238/225 |
| 3634286 | 4/1988 | Fed. Rep. of Germany | 238/10 E |
| 0903767 | 10/1945 | France | 238/10 E |
| 0614228 | 12/1948 | United Kingdom | 238/10 E |

*Primary Examiner*—Andres Kashnikow
*Assistant Examiner*—Mark T. Le
*Attorney, Agent, or Firm*—Klauber & Jackson

[57] ABSTRACT

A track jointer for use in connection with and for connecting together the ends of a track in a model track layout includes track sections for connecting the ends together, the jointer being located between the ends from a position substantially normal to the end, the track jointer and the track ends being connected together through the intermediaries of co-operating clips and plugs, the plugs being formed on or connected to the ends of the track jointer and the clips being carried on the track ends.

8 Claims, 3 Drawing Sheets

TRACK JOINTERS

This invention relates to track jointers, particularly but not exclusively for use in conjunction with the tracks of model railway layouts.

It is common practice to join rail and other tracks, in a model railway or other track layout, over a demountable base construction by the use of fish plates or rail jointers, but the use of such fish plates or rail jointers over such joints quickly deteriorate because the sections of baseboard on which the tracks are mounted have to be brought together whilst aligning the track itself. In addition, the track alignment becomes extremely difficult where there is more than one track over the baseboard joint, and is impossible or virtually impossible if the track is not at right angles to the line of the baseboard joint. Also, because the jointers have to project beyond the baseboard joint, the jointers soon become damaged in transit or in storage.

The difficulty in obtaining accuracy of alignment of the rails over a period of time whilst still being able to strip down and re-assemble the layout baseboards many times has prompted numerous articles in the Model Railway and other Press on ways to produce rigid joints in the baseboard so that the track can be secured to each side of the joint with just a butt joint between the rails on adjacent sections.

Rigid baseboard joints require heavy and rigid baseboard construction in order to maintain and transmit the loads and deflections caused by uneven floors and the like. This requirement for rigidity therefore produces heavy layouts that are difficult to transport and store.

The present invention aims to provide an improved jointing system for model track layouts which will overcome the problems of model railway and other track passing over baseboard construction joints which are dismantled and re-assembled many times, whilst still allowing relatively flexible and lightweight baseboard construction.

Accordingly, the present invention provides a track jointer for use in conjunction with and for connecting together the ends of a track in a model track layout, said jointer including track sections for connecting said ends together, said jointer being inserted between said ends from a position substantially normal to said ends.

Preferably, the jointer will be inserted between said ends from a position above said ends.

Said track jointer and said track ends will preferably be connected together through the intermediaries of cooperating clips and plugs.

Said track jointer will preferably include supporting means for said track sections, said supporting means being carried by a base forming part of said track jointer.

In order that the invention may be more readily understood, embodiments thereof will now be described, by way of example, reference being made to the accompanying drawings, wherein.

Figure 1:
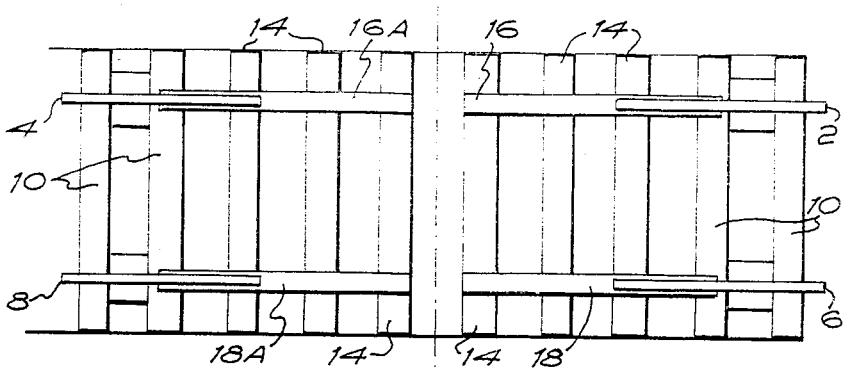
FIG. 1 is a plan view of a track jointer according to a first embodiment of the invention.
Figure 2:
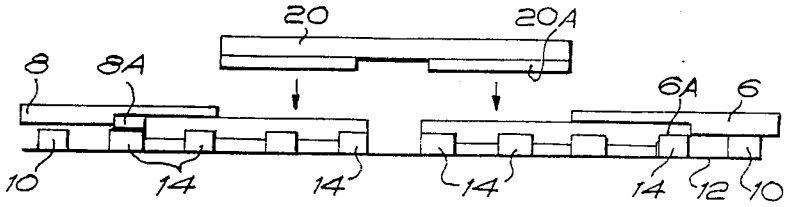
FIG. 2 is an elevation of the track jointer of FIG. 1 and shows removable rail sections for use therewith.
Figure 3A:
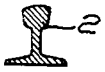
Figure 3B:
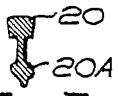
Figure 3C:
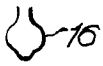
Figure 4:
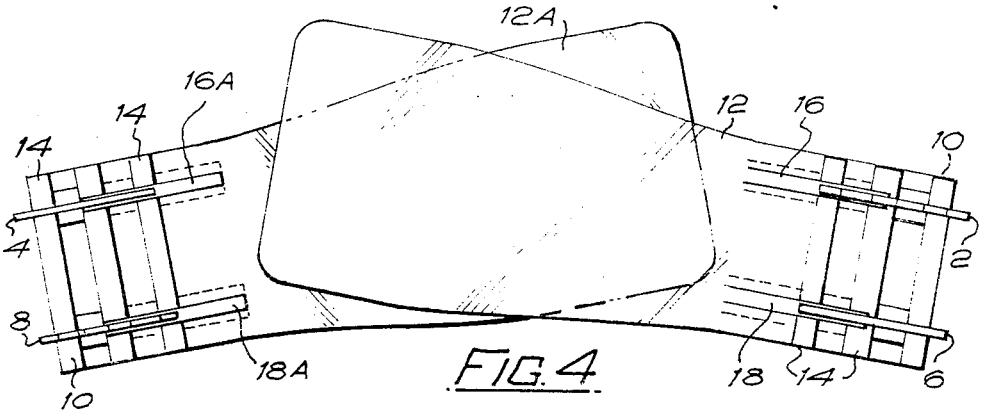
Figure 6:
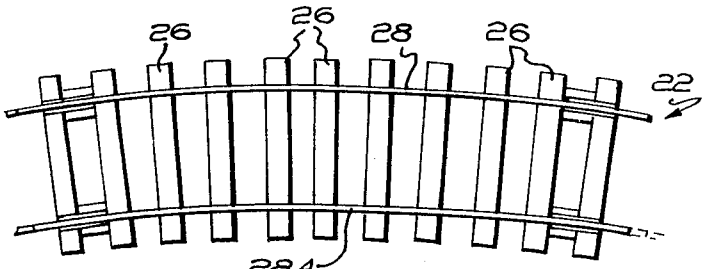
Figure 5:
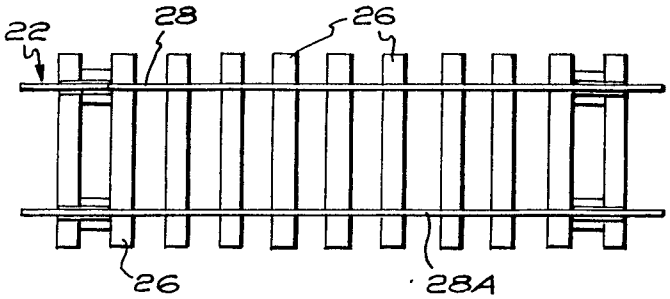
Figure 7:
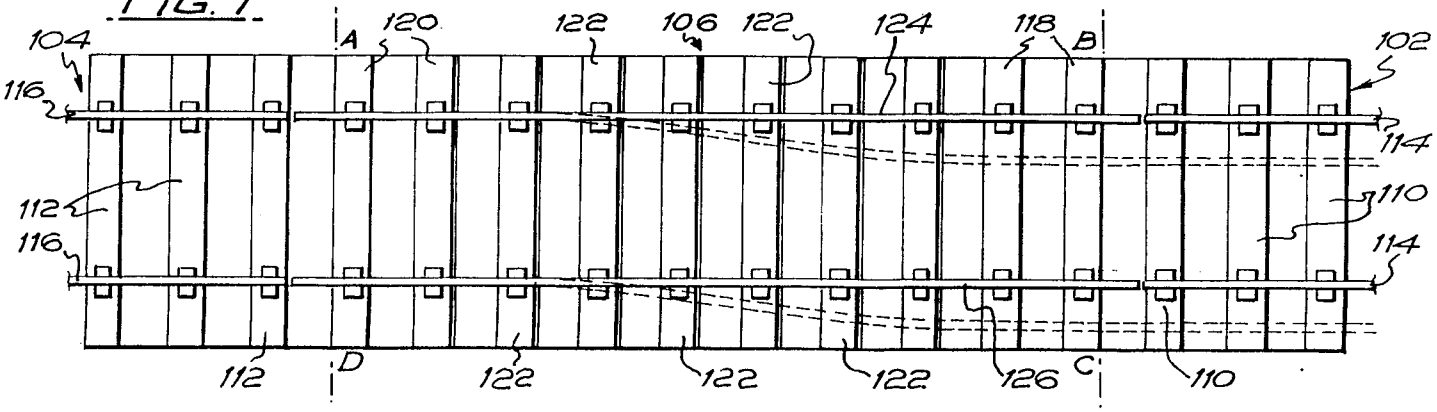
Figure 8:
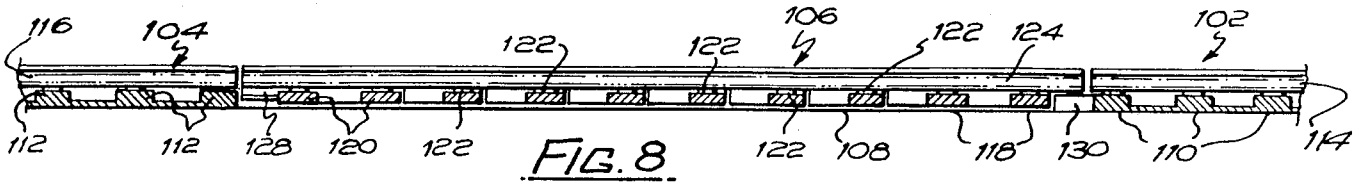

FIGS. 3A, 3B, and 3C are sections through various parts shown in FIGS. 1 and 2;

FIG. 4 is a plan view showing the ends of a track to be connected using a curved track jointer in accordance with the invention;

FIG. 5 is a plan view of the track jointer to be used in connecting the track ends shown in FIG. 4 and before being radiussed;

FIG. 6 shows the track jointer of FIG. 5 deformed to the required radius to connect together the track ends shown in FIG. 4;

FIG. 7 is a plan view of a track jointer in accordance with the invention showing the track jointer in position between the ends of a track to be connected;

FIG. 8 is a longitudinal elevation of FIG. 7; and

Figure 9:
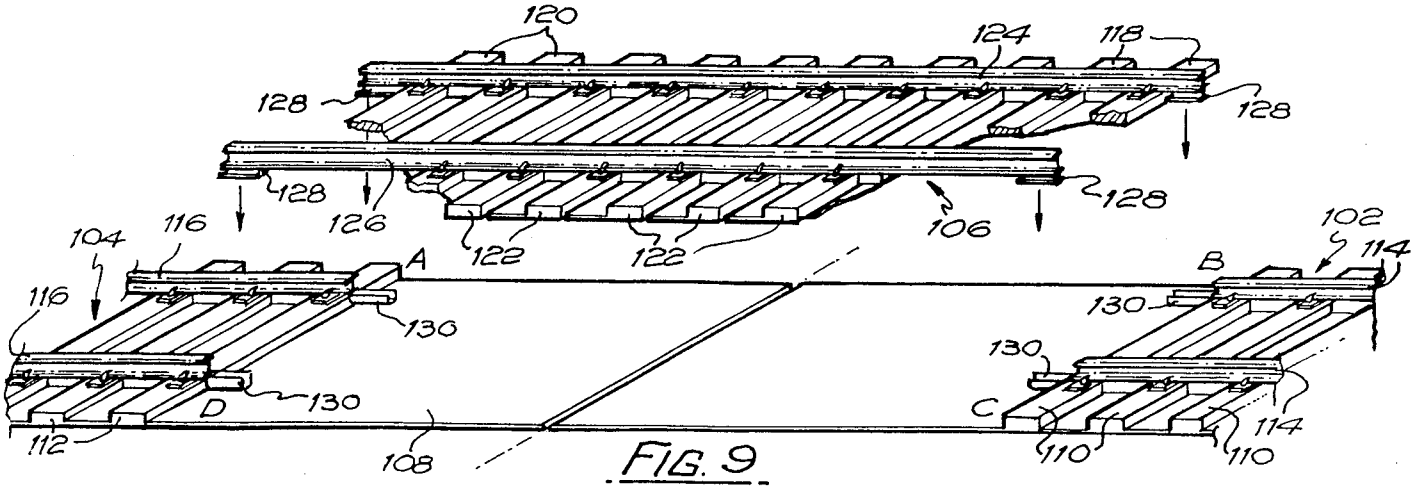

FIG. 9 is an exploded isometric view of the parts shown in FIGS. 7 and 8.

Referring to the drawings, and firstly to FIGS. 1 to 3C, the ends 2,4 and 6,8 of a track to be connected are shown supported by common sleepers 10 mounted on and secured to a base member 12, preferably formed of plastics material by injection moulding. Also mounted on and secured to the base member 12 is a plurality of sleepers 14. A track section is shown in FIG. 3A.

The sleepers 14 support female clips 16,16A and 18,18A which are secured to the sleepers and which are of the form shown in FIG. 3C. The clips are formed of metal and are secured to the sleepers 14 during the moulding process or alternatively by means of adhesive, the clips being deformed on their lower surfaces at positions corresponding to the positions of the sleepers 14 so as to ensure a positive bond between the clips and the sleepers. The clips are engaged on the track ends by horizontally sliding the clips onto the said ends.

Adapted to engage in the clips are lengths of track—one is indicated by reference numeral 20 in FIG. 2—whose lower extremities 20A are deformed to the shape shown in FIG. 3B so as to generally correspond to the shape of the female clips.

Thus, to connect the ends of the track—whose extremities, see 6A and 8A in FIG. 2, are formed to correspond to the lower extremities of the lengths of track 20, so that they may engage in the female clips—the lengths of track 20 are located above the female clips and pushed downwardly thereinto so as to bridge the gaps between said ends and to give continuity of the tracks and electric circuits thereof.

There is thus provided, by means of a track jointer in accordance with the invention, a simple and effective means of connecting together track ends in a model railway or other track layout.

Referring now to FIGS. 4 to 6, the ends 2,6 and 4,8 of a track to be connected each have a track jointer in accordance with FIGS. 1 and 2, and thus like parts have been given like reference numerals. In the case of FIG. 4, it will be seen that the plastics material bases 12 and 12A are extended so as to provide a base for the curved track jointer 22.

The track jointer 22 comprises a base (not shown), and a plurality of sleepers 26 carrying between them lengths of track 28 and 28A. The sleepers are loosely fixed to the lengths of track and solid blocking is provided between the ends of the sleepers carrying the track, and the ends of the lengths of track are formed as male plugs as previously described with reference to and as shown in FIG. 3B.

To insert the track jointer 22 into the gap between the track sections of FIG. 4, the ends of the track lengths 28 and 28A are inserted into the female clips 16,16A and 18,18A so as to provide continuity of the track and continuity of electric circuits flowing through the tracks, the tracks being radiussed as shown in FIG. 6 to provide such continuity.

Once attached and fixed in position relative to the bases 12 and 12A, so as to maintain the tracks in their desired positions, the bases are trimmed to remove excess material so as to form the base to the line of the sleepers.

With a curved track jointer as shown in FIG. 6, off-line sections of track may be connected together simply and effectively, the jointer enabling assembly and disassembly without damage to the various components.

Referring now to FIGS. 7 to 9, there is shown part of a model railway track layout comprising fixed sections 102 and 104 between which is located a removable track jointer indicated generally by reference numeral 106.

Each of the two fixed sections include a common baseboard 108 (which may be made up of a number of separate sections), a plurality of sleepers—respectively referenced 110 and 112—and spaced-apart lengths of metal track, respectively referenced 114 and 116. The sleepers 110 and 112 are fixed to the baseboard 108.

It will be seen from FIGS. 8 and 9 that the baseboard 108 is common not only to the fixed sections 102 and 104 but also to the intermediate track jointer 106, so that the baseboard 108 forms what might be termed a sub-base for the whole of the track layout.

The track jointer 106 includes spaced-apart pluralities of fixed sleepers—indicated respectively by reference numerals 118 and 120—and located between said pluralities is a plurality of loose or movable sleepers indicated by reference numerals 122.

It will be seen from FIGS. 8 and 9, that each of the loose or movable sleepers 122 carries a short length of base member, these base members serving to support the sleepers 122 in relation to the baseboard 108, to allow the sleepers 122 to assume other than parallel positions relative to each other, and to limit the proximity of adjacent sleepers 122 when they are in mutually parallel relationship. The upper surface of these base members will preferably be roughened for adhesion of track ballast.

In order to prevent adjacent sleepers sticking to one another, the right-hand (in the drawing) side of each loose or movable sleeper will be polished or otherwise treated.

The sleepers of the track jointer 106—both fixed and loose or movable—carry and support between them two short lengths 124 and 126 of flexible metal track.

In order to connect the track lengths 124 and 126 to the tracks 114 and 118, the track lengths 124 and 126, at each end thereof, are provided with male plugs 128 which are adapted to engage in female clips or sockets 130 located adjacent the free ends of the tracks 114 and 116, such that when the plugs are in engagement with the clips or sockets the tracks 114 are connected to the tracks 116 through the intermediaries of the lengths 124 and 126 to thereby form a continuous track on the layout.

In forming a desired track layout, and to facilitate easy and convenient stripping down and re-assembly of the layout, the track jointer 106 will be located between the fixed sections 102 and 104, and the whole will be secured to an auxiliary baseboard or baseboards (not shown) as a complete assembly—by the use, for example, of adhesive or double-sided tape or other suitable means—whereafter the track jointer will be removed. Thereafter, the baseboard will be cut, suitably on a line of demountable construction joint of said auxiliary baseboard.

With the track jointer as described, it is possible to accommodate horizontal track displacement or misalignment, as well as vertical misalignment and angular variations. In addition, the track jointer will permit acute angles between track and construction joint—preferably located anywhere within the area as marked A-B-C-D in FIGS. 7 and 9—as well as multiple intersecting joint conditions.

The track jointer, as well as being formed with straight tracks and with curved tracks, may also be formed with a combination of straight and curved tracks of various radii, and will be manufactured to suit different gauges of model railways.

The plugs, in each of the embodiments described above, may be fixed to the bottom of the track lengths of the track jointer, or they may be formed by deforming the bottom of a standard rail, or they may be formed during the formation of the rail itself so that the plugs are an integral part of the rail.

The track jointer provides electrical continuity without additional wiring or other connections, and because the permanent ends of the track are located well away from the edges of the baseboard, these ends are protected from damage during both transit and storage.

The track jointer allows the use of lightweight and semiflexible baseboard construction and provides an economic and practical solution to the age old problem of securing track across demountable baseboard joint(s).

It will be appreciated that whilst the invention has been described—and shown—in relation to a model railway layout, the invention is equally applicable to other track layouts, such as for example those used in connection with model motor and other wheeled vehicles and devices.

I claim:

1. A track joining assembly for connecting together ends of tracks of a model track layout, each said track being formed by two rail members connected together by sleeper members, said assembly comprising:

track jointer means for connecting together the ends of said tracks, said track jointer means including rail sections having opposite ends, each said rail section having an upper portion and a lower portion connected together by a narrow web portion; and resilient clip means for removably grasping the ends of said rail sections such that said rail sections are in line and adjacent to the ends of said rail members, each said clip means being permanently positioned directly on sleeper members and positioned adjacent the ends of said rail members, each said clip means being open at an upper end thereof so as to receive the lower portion of one end of a respective said rail section therein from a position substantially normal to and above said tracks, and each said clip means having a configuration corresponding to the lower portion of the rail sections of said track jointer means to as to securely grasp said rail sections therein.

2. A track joining assembly according to claim 1, wherein said lower portion of each said rail section includes a plug at each end thereof for engagement by said clip means, each said plug having a configuration corresponding to said clip means so as to be securely grasped thereby.

3. A track joining assembly according to claim 1, wherein said sleeper members are formed from a synthetic plastic material.

4. A track joining assembly according to claim 1, wherein at least some of said sleeper members are loosely connected to each said rail section so as to permit relative movement between at least some of said sleeper members.

5. A track joining assembly according to claim 1, wherein said rail sections are straight.

6. A track joining assembly according to claim 1, wherein said rail sections are curved.

7. A track joining assembly according to claim 1, wherein said track jointer means includes straight rail sections and curved rail sections.

8. A track joining assembly according to claim 1, wherein said clip means are adhered to said sleeper members.

* * * * *